US008764155B2

(12) United States Patent
Donahue et al.

(10) Patent No.: US 8,764,155 B2
(45) **Date of Patent: *Jul. 1, 2014**

(54) WEATHER BASED HUMIDITY ADJUSTMENT OF PRINTHEAD MAINTENANCE

(75) Inventors: Frederick Allen Donahue, Walworth, NY (US); Brian Gray Price, Pittsford, NY (US); Gary Alan Kneezel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 271 days.

This patent is subject to a terminal disclaimer.

(21) Appl. No.: 13/276,528

(22) Filed: Oct. 19, 2011

(65) Prior Publication Data

US 2013/0100196 A1 Apr. 25, 2013

(51) Int. Cl.
*B41J 29/38* (2006.01)

(52) U.S. Cl.
USPC ..... 347/17; 347/14; 347/23

(58) Field of Classification Search
USPC ..... 347/7, 9, 23, 14, 17, 19
See application file for complete search history.

(56) References Cited

U.S. PATENT DOCUMENTS

| | | | | |
|---|---|---|---|---|
| 5,289,207 | A * | 2/1994 | Ebisawa | 347/23 |
| 5,995,067 | A | 11/1999 | Terasawa et al. | |
| 7,350,902 | B2 | 4/2008 | Dietl et al. | |
| 2003/0071864 | A1 | 4/2003 | Walfer | |
| 2004/0100519 | A1 | 5/2004 | Kikuchi et al. | |
| 2009/0174741 | A1 | 7/2009 | Nagata et al. | |

* cited by examiner

*Primary Examiner* — Lam S Nguyen
(74) *Attorney, Agent, or Firm* — Peyton C. Watkins

(57) ABSTRACT

A method of controlling a maintenance operation of an inkjet printhead in an inkjet printer, the method includes providing at least one parameter of the maintenance operation as a function of humidity condition; receiving data corresponding to a current outdoor humidity condition; determining a humidity condition corresponding to the current outdoor humidity condition; and controlling the maintenance operation, wherein the at least one parameter is determined in accordance with the determined humidity condition.

20 Claims, 6 Drawing Sheets

WEATHER BASED HUMIDITY ADJUSTMENT OF PRINTHEAD MAINTENANCE

Reference is made to commonly assigned and co-pending U.S. patent application Ser. No. 13/276,510, filed Oct. 19, 2011, entitled "Geographically Based Humidity Adjustment of Printhead Maintenance", by Frederick A. Donahue, et al. and commonly assigned and co-pending U.S. patent application Ser. No. 13/276,550, filed Oct. 19, 2011, entitled "Indoor Humidity Condition Adjustment of Printhead Maintenance", by Frederick A. Donahue, et al., the disclosures of which are herein incorporated by reference.

FIELD OF THE INVENTION

The present invention relates generally to maintenance operations in an inkjet printer, and more particularly to controlling certain maintenance operations in a way that promotes efficient usage of ink as a function of humidity, without the need for a humidity sensor in the printer.

BACKGROUND OF THE INVENTION

An inkjet printing system typically includes one or more printheads and their corresponding ink supplies. Each printhead includes an ink inlet that is connected to its ink supply and an array of drop ejectors, each ejector including an ink pressurization chamber, an ejecting actuator and an orifice through which droplets of ink are ejected. The ejecting actuator can be one of various types, including a heater that vaporizes some of the ink in the pressurization chamber in order to propel a droplet out of the orifice, or a piezoelectric device which changes the wall geometry of the chamber in order to produce a pressure wave that ejects a droplet. The droplets are typically directed toward paper or other recording medium (sometimes generically referred to as paper herein) in order to produce an image according to image data that is converted into electronic firing pulses for the drop ejectors as the print medium is moved relative to the printhead.

Motion of the print medium relative to the printhead may consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads.

A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a direction that is substantially perpendicular to the print medium advance direction as the drops are ejected from the nozzles. After the carriage has printed a swath of the image while traversing the print medium, the print medium is advanced; the carriage direction of motion is reversed; and the image is formed swath by swath.

Inkjet ink includes a variety of volatile and nonvolatile components including pigments or dyes, humectants, image durability enhancers, and carriers or solvents. A key consideration in ink formulation is the ability to produce high quality images on the print medium. During periods when ink is not being ejected from an ejector, the ink viscosity at the nozzle can change. For example, the volatile components of the ink can evaporate through the nozzle. Such changes can make the drop ejection process nonuniform, so that the image quality can be degraded. In addition, dust, dried ink or other particulates can partially block a nozzle or make the wettability of the nozzle face around the nozzle nonuniform so that ejected drops can be misdirected from their intended flight paths.

In order to maintain the drop ejecting quality of the printhead so that high quality images are produced even after periods where one or more nozzles has been inactive, a variety of maintenance actions have been developed and are well known in the art. These maintenance actions can include capping the printhead nozzle face region during periods of nonprinting, wiping the nozzle face, periodically spitting drops from the nozzles into the cap or other reservoir that is outside the printing region, priming the nozzles by applying a suction pressure at the nozzle face.

The extent to which the nozzles of a printhead require maintenance depends upon the environmental conditions (such as humidity and temperature) in the printer, as well as the length of time during which ink has not been ejected. U.S. Pat. No. 5,995,067 discloses providing a humidity sensor as well as a temperature sensor within the printer. Depending upon measured humidity and temperature conditions within the printer, as well as elapsed time, the maintenance is controllably adjusted. For example, for low relative humidity and low temperature, a priming operation is performed. For various combinations of higher humidity and temperature, priming is not required, but various amounts of spitting can be done. For example, for higher levels of humidity, less spitting is required than at lower levels of humidity.

Temperature sensors are provided in many printers, but humidity sensors are found in fewer printers. Jetted ink drop size depends upon temperature for a given set of drop ejection conditions. Excellent and repeatable print quality typically depends upon sensing the temperature and modifying the drop ejection conditions (such as ejection pulse voltage or pulse width or waveform, or number of pulses) to keep the drop size approximately constant. Humidity has a less direct impact upon print quality so many printers do not include a humidity sensor in order to save expense. Humidity information is not available to such printers and maintenance routines are based simply on elapsed time and optionally also on temperature. In order for the maintenance routine to provide satisfactory printing results for all humidity levels, it is typically assumed that the humidity is at a low level. This is effective for providing quality printing, but is wasteful of both ink and time at higher levels of humidity where a less aggressive maintenance routine would suffice.

What is needed is a way to provide humidity information to adjust maintenance routines for printers that do not include a humidity sensor. For most users such humidity information will permit more efficient ink usage and less time spent on maintenance. More efficient ink usage makes it possible for the user to change ink supplies less frequently, saving the user both effort and money, and also putting less waste into the environment.

SUMMARY OF THE INVENTION

The present invention is directed to overcoming one or more of the problems set forth above. Briefly summarized, according to one aspect of the invention, the invention resides in a method of controlling a maintenance operation of an inkjet printhead in an inkjet printer, the method comprising providing at least one parameter of the maintenance operation as a function of humidity condition; receiving data corresponding to a current outdoor humidity condition; determining a humidity condition corresponding to the current outdoor humidity condition; and controlling the maintenance operation, wherein the at least one parameter is determined in accordance with the determined humidity condition.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
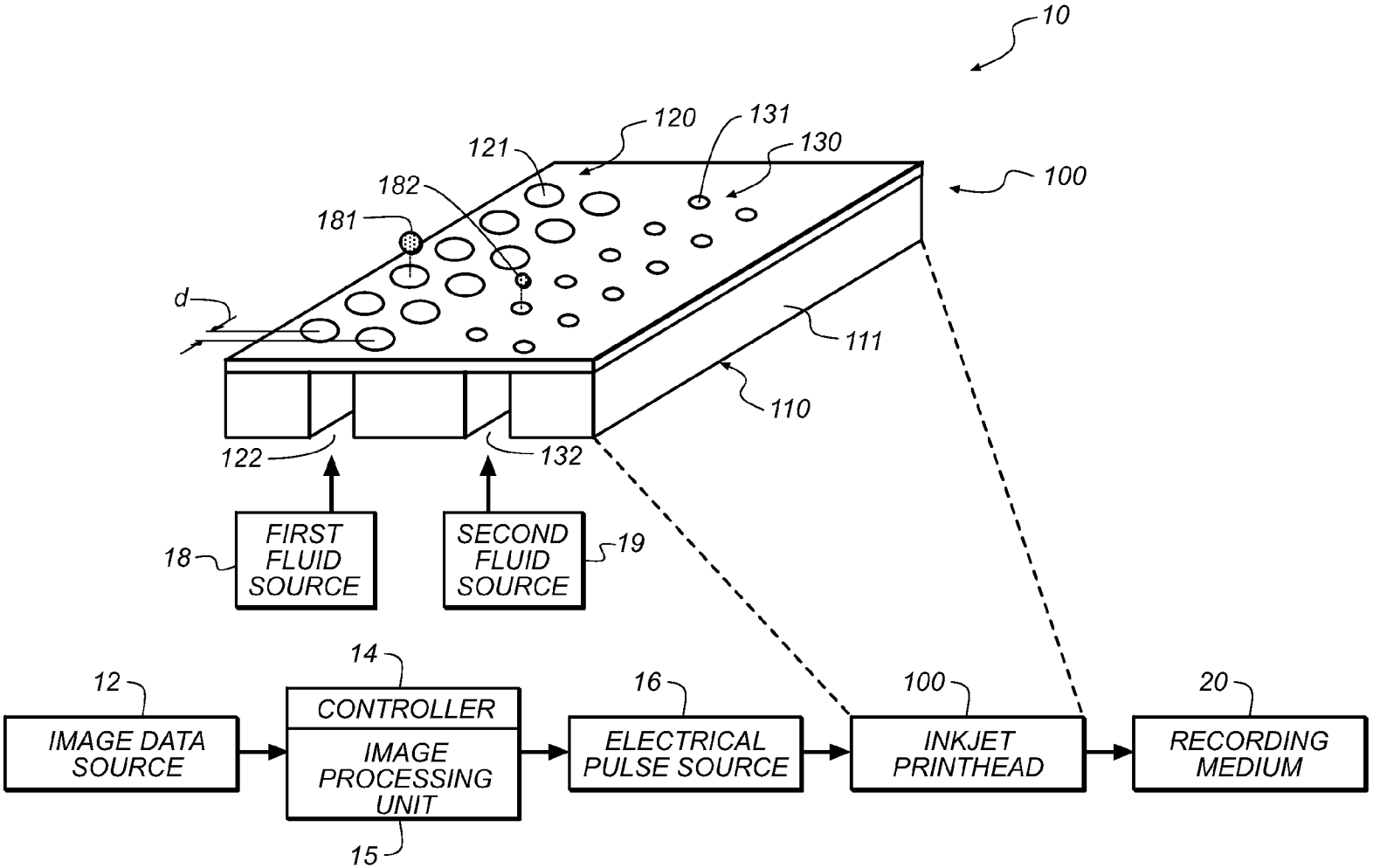
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays 120, 130 has two staggered rows of nozzles, each row having a nozzle density of 600 per inch. The effective nozzle density then in each array is 1200 per inch (i.e. d=1/1200 inch in FIG. 1). If pixels on a recording medium 20 were sequentially numbered along the paper advance direction, the nozzles 121, 131 from one row of an array 120, 130 would print the odd numbered pixels, while the nozzles 121, 131 from the other row of the array would print the even numbered pixels.

In fluid communication with each nozzle array 120, 130 is a corresponding ink delivery pathway 122, 132. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through a printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, a first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it is beneficial to have a single fluid source supplying ink to both the first nozzle array 120 and the second nozzle array 130 via ink delivery pathways 122 and 132 respectively. Also, in some embodiments, fewer than two or more than two nozzle arrays 120, 130 can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on the recording medium 20.

Figure 2:
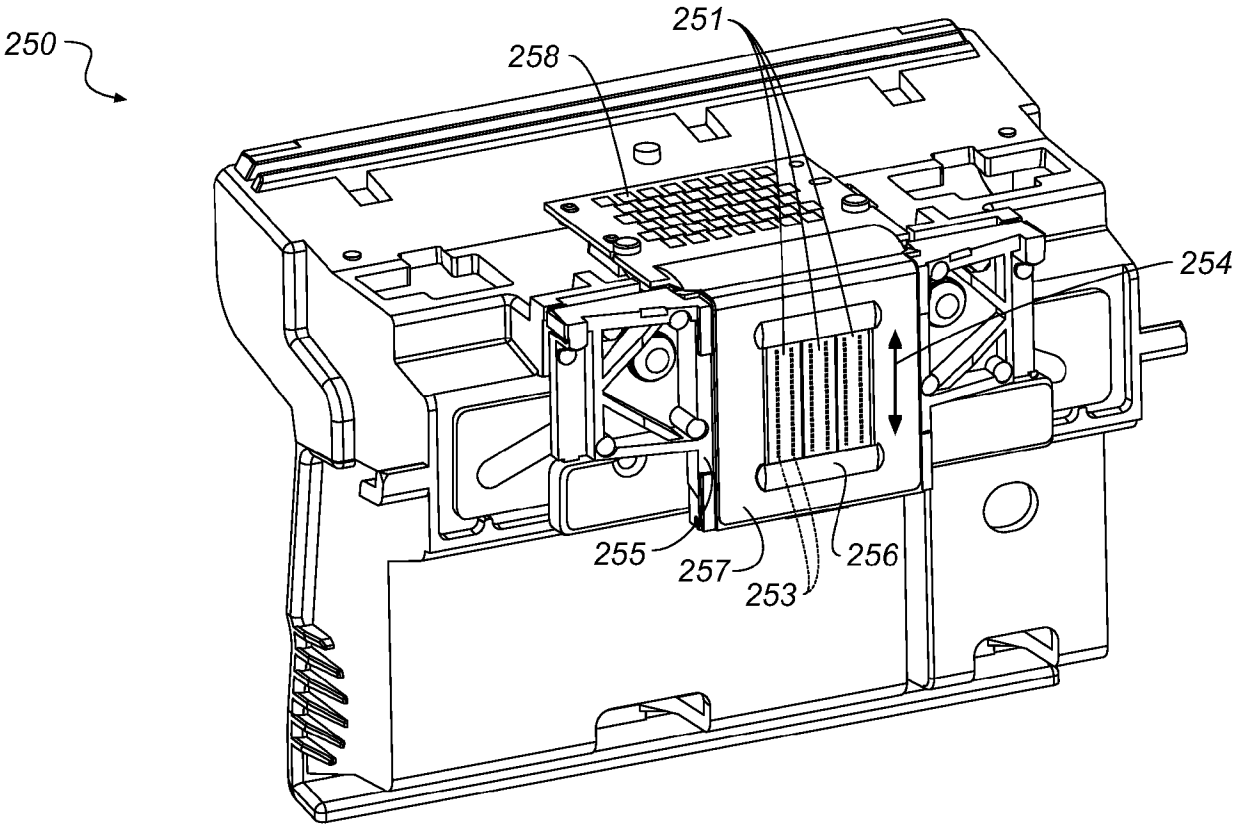
FIG. 2 is a perspective of a portion of a printhead.

FIG. 2 shows a perspective of a portion of a printhead 250, which is an example of the inkjet printhead 100. Printhead 250 includes three printhead die 251 (similar to printhead die 110 in FIG. 1) mounted on mounting substrate 255, each printhead die 251 containing two nozzle arrays 253, so that printhead 250 contains six nozzle arrays 253 altogether. The faces of the printhead die 251 that are visible in FIG. 2 are sometimes called the nozzle faces, since they include the nozzle arrays 253. The nozzle faces of the printhead die 251 are also sometimes called the nozzle face region of the printhead. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media 20 are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into a carriage 200 (see FIG. 3), connector board 258 is electrically connected to a connector (not shown) on the carriage 200, so that electrical signals can be transmitted to the printhead die 251.

Figure 3:
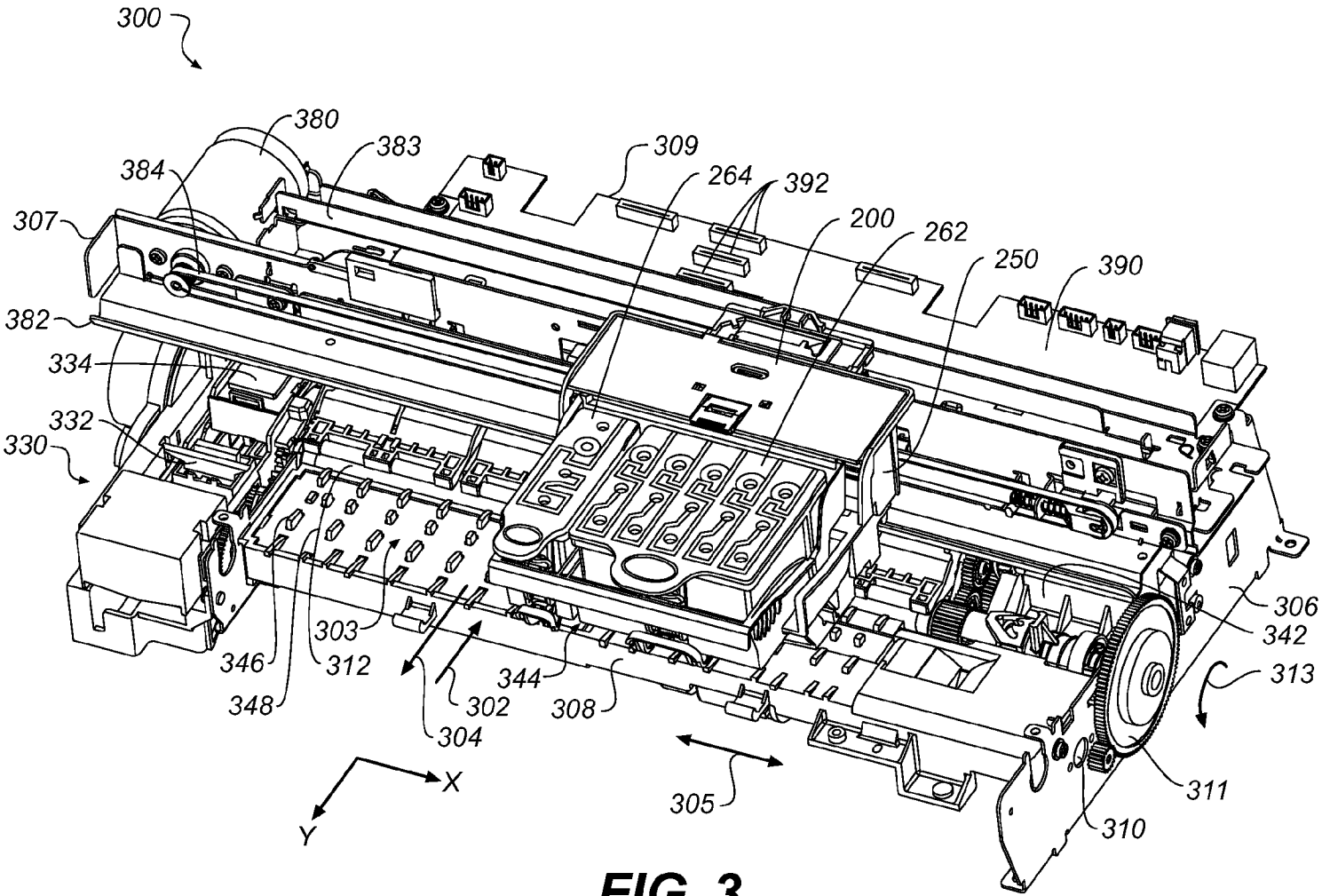
FIG. 3 is a perspective of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink tank 262 and single-chamber ink tank 264 are mounted in the printhead 250. The mounting orientation of printhead 250 is rotated relative to the view in FIG. 2, so that the printhead die 251 are located at the bottom side of printhead 250, the droplets of ink being ejected downward onto the recording medium in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. Paper or other recording medium (sometimes generically referred to as paper or media herein) is loaded along paper load entry direction 302 toward the front of printer chassis 308.

Figure 4:
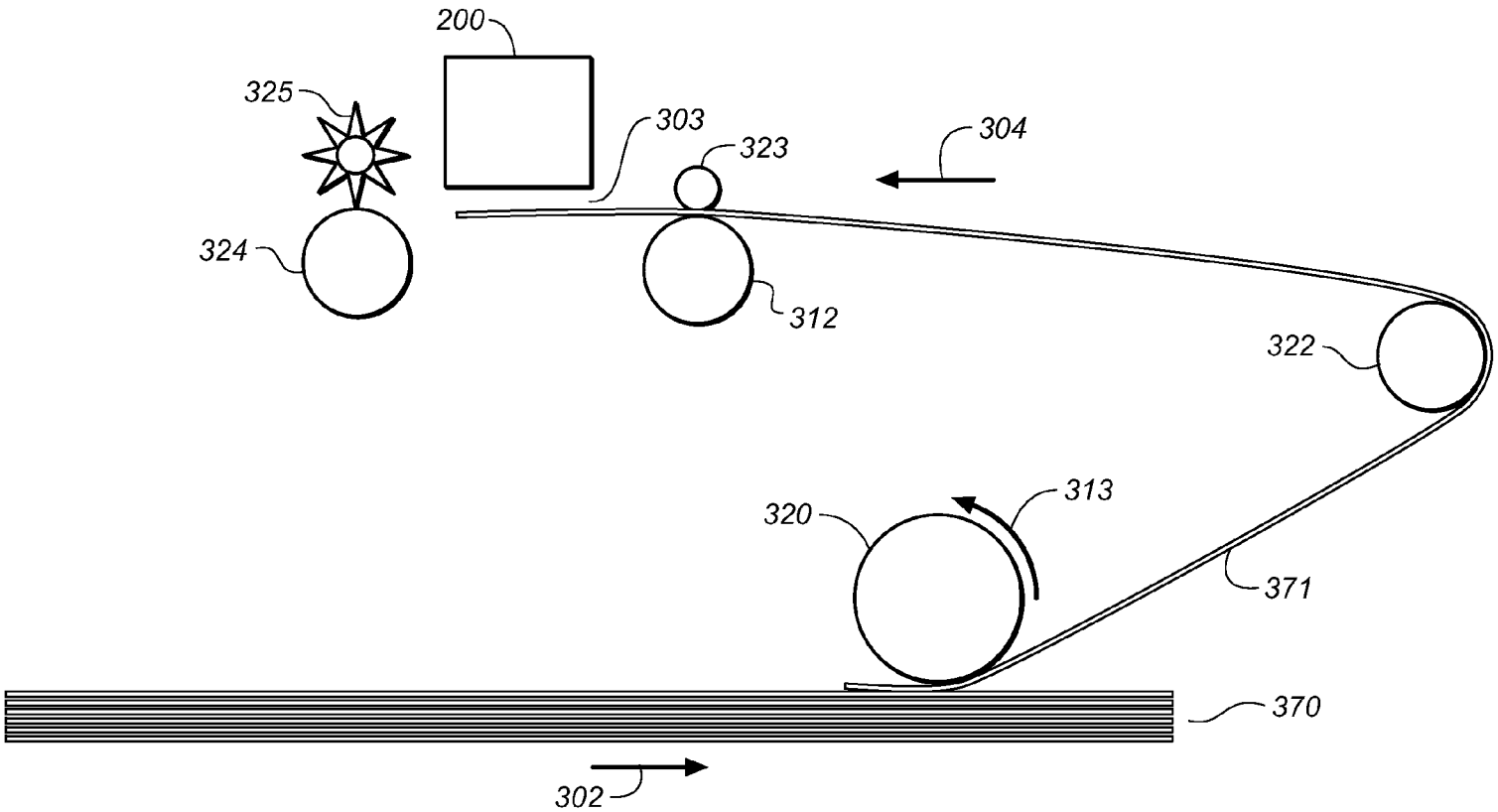
FIG. 4 is a schematic side view of an exemplary paper path in a carriage printer.

A variety of rollers are used to advance the medium 20 through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) is coaxially mounted on the feed roller shaft in order to monitor the angular rotation of the feed roller 312.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330. Maintenance station 330 includes wiper 332 and cap 334. In order to maintain the drop ejecting quality of the printhead 250 so that high quality images are produced even after periods where one or more nozzles has been inactive, a variety of maintenance actions have been developed and are well known in the art. These maintenance actions can include capping the printhead 250 to surround the nozzle face region with cap 334 during periods of nonprinting, wiping the nozzle face with wiper 332, periodically ejecting drops from the nozzles into cap 334 or other reservoir (such as spittoon 342) that is outside the printing region, and priming the nozzle arrays 253 by applying a suction pressure at the nozzle face when the printhead 250 is capped by cap 334.

Platen 344 supports the paper in the print region 303. In order to accommodate borderless printing of photographs, for example, where ink is deposited beyond the edges of the paper, platen 344 typically includes platen ribs 346 and platen absorber 348 surrounding platen ribs 346. The platen absorber 348 is an absorbent material that absorbs ink drops that are printed beyond the edges of the paper. Platen ribs 346 extend upward from platen absorber 348 and provide the surface upon which the paper is supported in print region 303. Platen ribs 346 are located in positions where it is unlikely that borderless printing will take place. For example, they are typically not located near where the edges of standard width paper would be located in print region 303. At the end of the print region 303 opposite maintenance station 330 is spittoon 342. Spittoon 342 is typically a recessed cavity leading to an absorbent material (not shown) where the printhead 250 can eject maintenance drops without the carriage 200 needing to move back to the side of the printer having the maintenance station 330. In some embodiments, some of the maintenance drops are ejected in print region 303 between cap 334 and spittoon 342. For example, maintenance drops can be ejected onto platen absorber 348 beyond the edges of the paper. Some maintenance drops can even be ejected onto the paper itself without overly degrading the image quality, as described, for example, in U.S. Patent Application Publication No. 2009/0174741. Because maintenance drop ejection is beneficial during a print job if some of the nozzles have not fired for a time interval that is greater than a predetermined time interval while the nozzle face region of printhead 250 is uncapped by cap 334, providing alternative receivers of maintenance drops, such as spittoon 342, platen absorber 348 and even the paper itself can help improve productivity by not requiring that printhead 250 be moved to the cap 334 each time that maintenance drop ejection is required.

Toward the rear of the printer chassis 309, in this example, is located an electronics board 390, which includes cable connectors 392 for communicating via cables (not shown) to the printhead carriage 200 and from there to the printhead 250. Also on the electronics board 390 are typically mounted motor controllers for the carriage motor 380 and for the paper advance motor, a processor and/or other control electronics (shown schematically as controller 14 and image processing unit 15 in FIG. 1) for controlling the printing process (including maintenance operations), and an optional connector for a cable to a host computer.

Embodiments of the present invention control maintenance operations, particularly maintenance operations to address jetting quality that is dependent upon humidity, in such a way that ink is used more efficiently in the printer for printing images rather than for maintenance. In particular, for a printer that does not include a humidity sensor, the embodiments provide methods that include ways of determining a humidity condition, so that less aggressive maintenance can be done at higher humidity, rather than always using a default maintenance routine that is effective even at low humidity but uses more ink. The reduced ink consumed in maintenance operations reduces cost to the user, and also reduces the amount of waste that is returned to the environment. In some instances, reducing the occurrence of ejecting maintenance drops from an uncapped printhead 250 during a print job can also increase printing throughput, because less time is spent on maintenance operations during the print job.

Figure 5:
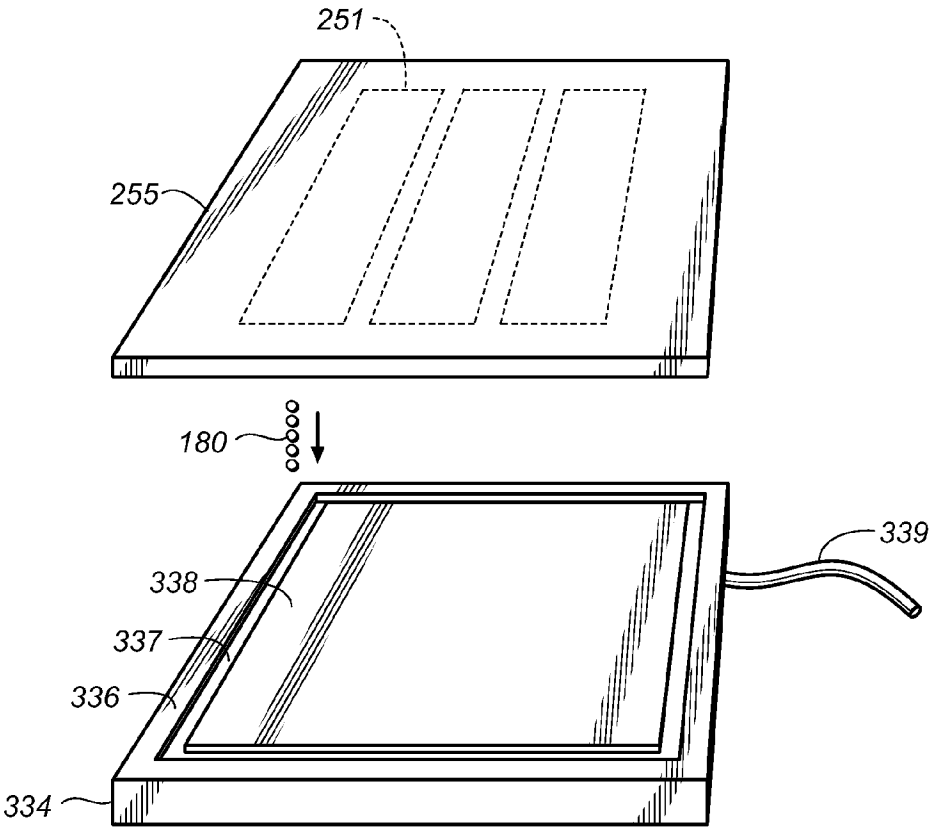
FIG. 5 is a schematic of a portion of a printhead ejecting ink droplets into a maintenance station cap.

FIG. 5 schematically shows a portion of a printhead 250 and a cap 334. As in FIG. 2, three printhead die 251 are mounted on mounting substrate 255. The printhead die 251 are positioned over cap 334. In some maintenance operations such as priming, the cap 334 and its sealing surface 336 are brought into sealing contact with the face of the mounting substrate 255 surrounding the printhead die 251. In addition, during non-printing times the printhead is sealingly capped by cap 334 to protect the printhead die 251 and to inhibit evaporation from the nozzle arrays 253. For clarity in FIG. 5, the cap 334 and the mounting substrate 255 are shown as being separated, so that the droplets 180 being ejected from the leftmost printhead die 251 are visible. Within a recess 337 of cap 334 is a porous member 338 that can absorb and distribute a quantity of ink. Waste ink tubing 339 extends from cap 334 and is typically connected to a suction pump (not shown) in order to remove excess liquid from cap 334. The suction pump also provides the suction pressure used during priming of the nozzle arrays 253.

Sucking ink out of the nozzle arrays 253 uses much more ink for maintenance than ejecting maintenance drops does, and is typically used only when the ink in the nozzle arrays 253 is believed to be highly viscous, such as might occur due to evaporation of volatile components during a long period without jetting in a very dry environment, or if there is believed to be a significant amount of air accumulated in the printhead 250 (which can also be worse at low humidity). However, if no humidity information is available, the maintenance operations are typically designed to be effective even in very dry environments. If a print job is sent to the printer and the printhead 250 has not printed for a week, for example, a priming operation might be performed using about 0.3 ml of ink. If the printhead has not printed for two weeks, an extended duration priming operation or a repeated priming operation might be performed using about 0.6 ml of ink.

Ejecting maintenance drops, such as droplets 180, is selectably controllable at a relatively low level of ink usage. For example, ejecting 50 maintenance drops from each nozzle in a nozzle array 253 (FIG. 2) would use about 0.2 micro liter of ink, while ejecting 100 maintenance drops from each nozzle in the nozzle array 253 would use about 0.4 micro liter. The ink used in a single instance of ejecting maintenance drops is small compared to the 10 ml of ink (or more) that is typically held in each chamber of ink tanks 262 and 264. However, repeated instances of ejecting maintenance drops over the lifetime of the ink tanks 262 and 264 can add up to a significant amount of ink. Therefore, it is advantageous to reduce the number of instances of ejecting maintenance drops, as well as the number of instances of priming. It can also be advantageous to reduce the number of maintenance drops ejected during a maintenance operation whenever possible. Furthermore, for removing more viscous ink in the nozzles, it can be advantageous to modify the pulse condition (such as pulse width, voltage, number of pulses or pulse waveform) or to preheat the printhead 250 during the ejection of maintenance drops. Therefore, controlling the maintenance operations, where at least one parameter of the maintenance operation is a function of humidity condition, according to a determined humidity condition can be advantageous.

Several embodiments will be described below for providing a reasonable estimate of the humidity in the environment of the printer where there is no humidity sensor in the printer and using the estimated humidity to control a maintenance operation of an inkjet printhead in an inkjet printer. The generalized form of the embodiments is illustrated by the flow chart in FIG. 6, which can be implemented according to software or firmware in the printer or computing devices to which the printer is connected.

Figure 6:
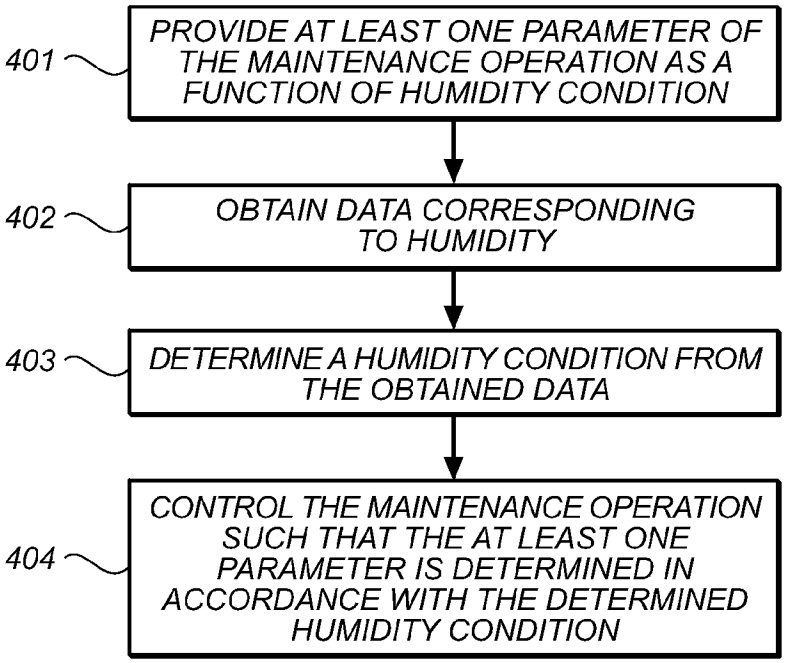
FIG. 6 is an exemplary generalized flow chart of the steps of the method of embodiments of present invention.

As shown in FIG. 6, Step 401 of a method for controlling a maintenance operation of an inkjet printhead in an inkjet printer is to provide at least one parameter of the maintenance operation as a function of humidity condition. The maintenance operation can include ejecting drops of ink, for example into the cap 334, the spittoon 342, the platen absorber 348 (FIG. 3) or even the recording medium 20 (FIG. 1). Parameters of this maintenance operation that can be provided as a function of humidity condition include a) a time interval between a most recent ejection of drops of ink and a time to initiate ejection of drops for maintenance; b) a number of drops of ink to be ejected during the maintenance operation; c) a pulse condition for electrical pulse source 16 (FIG. 1) for ejecting the drops of ink during the maintenance operations; or d) an amount of preheating of the inkjet printhead 250 prior to the ejection of drops during the maintenance operation. With regard to parameter a), the "most recent ejection of drops of ink" can refer either to ink that was ejected during the previous maintenance ejection of ink or to ink that was ejected during printing of an image.

Alternatively for Step 401, the maintenance operation can include priming the printhead 250. Parameters of this maintenance operation that can be provided as a function of humidity conditions include a) a time interval between a most recent ejection of drops of ink and a time to initiate priming; b) a duration of the priming operation; or c) a number of repeats of the priming operation.

Step 402 of the method for controlling a maintenance operation of an inkjet printhead is to obtain data corresponding to humidity. This data is obtained differently in each of the three embodiments described below. In a first embodiment the data is obtained by providing a table of average humidity conditions for a geographic locale in which the printer is located and providing a current date. In a second embodiment, the data is obtained by receiving data corresponding to a current outdoor humidity condition for a geographic locale in which the printer is located. In a third embodiment, the data is obtained by receiving data corresponding to a current indoor humidity condition.

Step 403 of the method for controlling a maintenance operation of an inkjet printhead is to determine a humidity condition corresponding to the obtained data. As will be described below relative to the three embodiments, in some instances the humidity condition is determined directly from the obtained data. In other instances, additional data is obtained such that the additional data is not humidity data, but is data that can influence humidity at the location of the printer. In these other instances, step 403 includes determining the humidity condition based on both the data obtained in step 403 corresponding to humidity and to the additional data that is not humidity data.

Step 404 of the method is to control the maintenance operation such that the at least one parameter provided in step 401 is determined in accordance with the humidity condition determined in step 403. For example, if the at least one parameter includes a time interval between a most recent ejection of drops of ink and a time to initiate ejection of drops for maintenance, a longer time interval would be used at a higher humidity level than at a lower humidity level, so that ejection of maintenance drops is done less frequently at higher humidity. Similarly, if the at least one parameter is a time interval between a most recent ejection of drops of ink and a time to initiate priming, a longer time interval would be used at a higher humidity level than at a lower humidity level, so that priming is done less frequently at higher humidity. Even if the humidity condition is not always higher than the low humidity conditions that are typically assumed as a default in order to control maintenance operations that will provide satisfactory results even at low humidity, over the lifetime of the ink tank, many users will benefit by cost savings and improved printing throughput, even though their printer does not include a humidity sensor.

As indicated above relative to step 402, in a first embodiment, the data is obtained by providing a table of average humidity conditions for a geographic locale in which the printer is located and providing a current date. In particular, the table can be provided within printer memory or within the memory of the host computer when the printer is installed. Such a table can include average humidity conditions as a function of time of the year for a plurality of geographic codes. The geographic codes can be zip codes for example. The user would be prompted to enter the zip code where the printer is located. This would indicate (e.g. to software or firmware) which portion of the table to use. Referring to the current date in the table would then indicate current average outdoor humidity conditions in that locale. The current date information can include month, or month plus day of the month, or month plus day of the month plus current time of day. Rather than asking the user to enter the geographic code, alternatively the geographic code can be obtained from a website. Presently existing websites can determine an approximate location (typically expressed as latitude and longitude as a geographic code) via an IP address or an internet service provider. In some instances the geographic code is obtained via a computing device (e.g. a host computer that is linked to the printer by cables or wirelessly, or a mobile communications device that is linked to the printer). In some instances the geographic code is obtained via a remote network server (e.g. part of what is sometimes referred to as "the cloud"). In one aspect of this first embodiment, step 403 of determining a humidity condition from the obtained data includes providing the average humidity condition from the table, corresponding to the current date.

As indicated above relative to step 402, in a second embodiment, the data is obtained by receiving data corresponding to a current outdoor humidity condition for a geographic locale in which the printer is located. In particular, the location of the printer can be determined as indicated above for the first embodiment, i.e. the user can enter a geographic code or the location can be determined via an IP address or an internet service provider. Presently existing websites can provide humidity data for a given date and time of day. For printers that are network-connected, the step of receiving data corresponding to the current outdoor humidity condition can include receiving the data directly by the printer. Alternatively, the data can be received from a website on an internet-connected device (such as a computer or mobile communications device) and then transmitted to the printer. Step 403 of determining a humidity condition from the obtained data can include providing the current outdoor humidity condition. The data transmitted to the printer can be the same as the current outdoor humidity data received from a website.

In the first and second embodiments, step 403 of determining a humidity condition from the obtained data can thus simply include using the current average outdoor humidity or the current actual outdoor humidity respectively. However, many printers are located in buildings having heating, ventilation and air conditioning systems that modify the indoor humidity relative to the outdoor humidity. In other aspects of these embodiments, step 403 of determining a humidity condition from the obtained data also can include using additional data that is not itself humidity data, but that influences humidity conditions. During the summer, many air-conditioned buildings provide reduced temperature and humidity indoors relative to outdoor conditions. Thus, directly using the outdoor humidity in the summer can result in controlling maintenance operations in a less aggressive way than is appropriate for the actual environmental conditions of the printer. One way to infer whether the printer is in an air conditioned environment is to monitor the temperature of the printer. As indicated above, while many inkjet printers do not include humidity sensors, nearly all inkjet printers include temperature measuring devices, because drop size is directly related to temperature. The temperature measuring device can be provided as a separate component in the body of the printer. Alternatively, the temperature measuring device can be provided on the printhead 250, for example being integrated as part of the printhead die 251 (FIG. 2). For the purpose of determining a humidity condition, the temperature of the printer would typically be measured when the printer is not printing and generating internal heat. If it is found that the measured temperature (i.e. the actual temperature where the printhead is located) is different from the average temperature for the current date (also provided in a table in the first embodiment) or different from data received on the current outdoor temperature (second embodiment), then in step 403 a humidity condition would be specified that is different from the current average outdoor humidity or the current actual outdoor humidity respectively. The calculation of the specified humidity condition can be done either in the printer itself, or in a computing device that is linked to the printer, and then transmitted to the printer.

As an example, humidity conditions were compared indoors and outdoors in Rochester, N.Y. during the late spring. It was found that for outdoor humidity ranging from 30% to 97% and corresponding to an outdoor moisture vapor concentration ranging from $4\times10^{-6}$ grams/ml to $11\times10^{-6}$ grams/ml, the indoor moisture vapor concentration was approximately 70% of the outdoor moisture vapor concentration.

If the outdoor temperature (average outdoor temperature for the current date in the first embodiment or current outdoor temperature in the second embodiment) is greater than a first predetermined temperature (e.g. 80 degrees F.) and the actual temperature measured at the printer is less than that outdoor temperature, then it is assumed that the printer environment is air conditioned and a specified humidity condition is specified to be lower than the outdoor humidity (e.g. the average outdoor humidity for the current date in the first embodiment, or the current outdoor humidity in the second embodiment).

During the heating season, the indoor humidity can also be lower than the outdoor humidity, particularly if there is no humidification system in the building in which the printer is operated. If the outdoor temperature (average outdoor temperature for the current date in the first embodiment or current outdoor temperature in the second embodiment) is less than a second predetermined temperature (e.g. 50 degrees F.) and the actual temperature measured at the printer is greater than that outdoor temperature, then it is assumed that the printer environment is heated and a specified humidity condition is specified to be lower than the outdoor humidity (e.g. the average outdoor humidity for the current date in the first embodiment, or the current outdoor humidity in the second embodiment).

As indicated above relative to step 402, in a third embodiment, the data is obtained by receiving data corresponding to a current indoor humidity condition. So-called smart buildings include humidity sensors as well as temperature sensors and are capable of transmitting data on indoor conditions such as current indoor humidity. Such directly monitored indoor humidity can be more accurate than that provided in the first and second embodiments, but requires that the printer be located in a building having the capability of monitoring and transmitting indoor humidity data. In step 403, determining a humidity condition corresponding to a current indoor humidity condition can simply include providing the current indoor humidity condition that was measured in the building. In some instances a network-connected inkjet printer would receive the current indoor humidity data directly. In other instances a network-connected device (e.g. a computer or a mobile communications device) would receive the indoor humidity data and either transmit this same data to the inkjet printer, or calculate modified humidity condition data that is transmitted to the inkjet printer as the determined humidity condition.

In particular for the third embodiment, it is known that humidity can vary according to which floor of the building the printer is located on. In a typical home in the summer, a printer located in a basement can experience higher humidity conditions than on a floor at higher elevation. For buildings that transmit data that is monitored at a single floor within the building, the determined humidity condition can be modified according to the elevation within the building. Elevation at which the inkjet printer is located (e.g. basement, first floor, or second floor) can be provided, for example by the user. Step 403 of determining a humidity condition can include specifying a humidity condition that is higher for a first elevation than it is for a second elevation, if the first elevation is less than the second elevation.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
180 Droplets
181 Droplet(s) (ejected from first nozzle array)
182 Droplet(s) (ejected from second nozzle array)
200 Carriage
250 Printhead
251 Printhead die
253 Nozzle array
254 Nozzle array direction
255 Mounting substrate
256 Encapsulant
257 Flex circuit
258 Connector board
262 Multi-chamber ink tank
264 Single-chamber ink tank
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
332 Wiper
334 Cap
336 Sealing surface
337 Recess
338 Porous medium
339 Waste ink tubing
342 Spittoon
344 Platen
346 Platen ribs
348 Platen absorber
370 Stack of media
371 Top piece of medium
380 Carriage motor
382 Carriage guide rail
383 Encoder fence
384 Belt
390 Printer electronics board
392 Cable connectors
401-404 Generalized steps in controlling maintenance

The invention claimed is:

1. A method of controlling a maintenance operation of an inkjet printhead in an inkjet printer, the method comprising:
providing at least one parameter of the maintenance operation as a function of humidity condition;
measuring a temperature at the inkjet printer;
receiving data corresponding to a outdoor humidity condition and an outdoor temperature for a geographic locale of a building in which the inkjet printer is located;
calculating an indoor humidity condition based on the outdoor humidity condition, the outdoor temperature and the measured temperature at the printer; and
controlling the maintenance operation, wherein the at least one parameter is determined in accordance with the calculated indoor humidity condition.

2. The method according to claim 1, wherein the maintenance operation includes ejecting drops of ink.

3. The method according to claim 2, wherein the maintenance operation further includes ejecting drops of ink into a cap.

4. The method according to claim 2, wherein the at least one parameter includes a time interval between a most recent ejection of drops of ink and a time to initiate ejection of drops for maintenance.

5. The method according to claim 4, wherein controlling the maintenance operation includes specifying a first time interval at a first determined humidity condition, and a second time interval at a second determined humidity condition, the second determined humidity condition being higher than the first determined humidity condition, wherein the second time interval is longer than the first time interval.

6. The method according to claim 2, wherein the at least one parameter includes a number of drops of ink to be ejected during the maintenance operation.

7. The method according to claim 2, wherein the at least one parameter includes a pulse condition for ejecting the drops of ink during the maintenance operation.

8. The method according to claim 2, wherein the at least one parameter includes an amount of preheating of the inkjet printhead prior to the ejecting of drops of ink during the maintenance operation.

9. The method according to claim 1, wherein the maintenance operation includes priming the printhead.

10. The method according to claim 9, wherein the at least one parameter includes a time interval between a most recent ejection of drops of ink and a time to initiate priming.

11. The method according to claim 1, the inkjet printer being a network-connected inkjet printer, and the step of receiving data corresponding to the current outdoor humidity condition including receiving the data directly by the printer.

12. The method according to claim 11, wherein the data corresponding to the outdoor humidity condition is provided by a website.

13. The method according to claim 1, the step of receiving data corresponding to the current outdoor humidity condition including:

receiving data corresponding to the current outdoor humidity condition from a website on an internet-connected device; and transmitting data to the inkjet printer.

14. The method according to claim 13, wherein the data transmitted to the inkjet printer is the same as the data received from the website.

15. The method according to claim 13, wherein the data transmitted to the inkjet printer is related to the determined humidity condition.

16. The method according to claim 1, further including:

receiving data corresponding to a current outdoor temperature condition;

determining an actual temperature where the printer is located; and specifying a humidity condition that is different from the current outdoor humidity condition if the actual temperature is different from the current outdoor temperature condition.

17. The method according to claim 16, the step of specifying a humidity condition that is different from the outdoor humidity condition including specifying a humidity condition that is lower than the outdoor humidity condition if the actual temperature is less than the outdoor temperature for the date, and if the outdoor temperature for the date is greater than a first predetermined temperature.

18. The method according to claim 16, the step of specifying a humidity condition that is different from the outdoor humidity including specifying a humidity condition that is lower than outdoor humidity condition if the actual temperature is greater than the outdoor temperature for the date, and if the outdoor temperature for the date is less than a second predetermined temperature.

19. The method according to claim 16, the step of determining an actual temperature where the printer is located including measuring the actual temperature using a temperature measuring device provided in the printer.

20. The method according to claim 16, the step of determining an actual temperature where the printer is located including measuring the actual temperature using a temperature measuring device provided in the printhead.

* * * * *